US011965393B2

(12) United States Patent
Knight et al.

(10) Patent No.: US 11,965,393 B2
(45) Date of Patent: Apr. 23, 2024

(54) DOWNHOLE SETTING ASSEMBLY WITH SWITCH MODULE

(71) Applicant: G&H Diversified Manufacturing, LP, Houston, TX (US)

(72) Inventors: Benjamin Vascal Knight, Katy, TX (US); Charles Levine, Waxahachie, TX (US); Joe Noel Wells, Lindale, TX (US); Timmothy Alain Lee, Tomball, TX (US); Ryan Ward, Tomball, TX (US); William Caruana, Cypress, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 85 days.

(21) Appl. No.: 17/742,185

(22) Filed: May 11, 2022

(65) Prior Publication Data

US 2022/0364430 A1 Nov. 17, 2022

Related U.S. Application Data

(60) Provisional application No. 63/187,145, filed on May 11, 2021.

(51) Int. Cl.
*E21B 33/13* (2006.01)
*E21B 23/04* (2006.01)

(52) U.S. Cl.
CPC ..... *E21B 33/13* (2013.01); *E21B 23/04* (2013.01)

(58) Field of Classification Search
CPC ..... E21B 33/13; E21B 23/04; E21B 23/065
See application file for complete search history.

(56) References Cited

U.S. PATENT DOCUMENTS 2,807,325 A * 9/1957 Webb ..... E21B 23/065 166/134
3,246,707 A * 4/1966 Bell ..... F42D 1/055 175/4.54
4,100,978 A * 7/1978 Boop ..... E21B 43/1185 102/306
6,035,880 A * 3/2000 Gazda ..... E21B 43/11852 137/68.16
9,810,035 B1 * 11/2017 Carr ..... E21B 23/065
10,036,236 B1 * 7/2018 Sullivan ..... E21B 43/11855
10,273,788 B2 * 4/2019 Bradley ..... F42B 3/08
(Continued)

*Primary Examiner* — Steven A MacDonald
(74) *Attorney, Agent, or Firm* — Conley Rose, P.C.

(57) ABSTRACT

A setting tool includes a housing having an initiator compartment to receive an initiator for initiating combustion of a combustible element, a combustion compartment to receive the combustible element, and a switch compartment to at least partially receive a switch circuit for activating the initiator, a piston configured to impart a setting force against the plug in response to combustion of the combustible element, and an interrupt flowpath configured to connect at least one of the combustion compartment and the initiator compartment with the switch compartment whereby combustion products that may be created in the initiator compartment or combustion compartment would be circulated from the at least one of the combustion compartment and the initiator compartment to the switch compartment to disconnect the switch circuit in response to the activation of the initiator charge.

16 Claims, 12 Drawing Sheets

(56) References Cited

U.S. PATENT DOCUMENTS

| | | | | |
|---|---|---|---|---|
| 2002/0000320 | A1* | 1/2002 | Gissler | F16L 29/04 166/241.5 |
| 2005/0022987 | A1* | 2/2005 | Green | E21B 47/20 166/250.17 |
| 2015/0068723 | A1* | 3/2015 | Wells | E21B 33/13 166/55.1 |
| 2015/0292288 | A1* | 10/2015 | Kasperski | E21B 27/02 166/65.1 |
| 2017/0051586 | A1* | 2/2017 | Wells | E21B 43/1185 |
| 2017/0211363 | A1* | 7/2017 | Bradley | F42B 5/035 |
| 2017/0370194 | A1* | 12/2017 | Hernandez Lopez | E21B 33/12 |
| 2018/0202249 | A1* | 7/2018 | Harrington | E21B 23/04 |
| 2019/0195054 | A1* | 6/2019 | Bradley | F42D 1/04 |
| 2020/0256166 | A1* | 8/2020 | Knight | E21B 43/1185 |
| 2020/0256168 | A1* | 8/2020 | Knight | E21B 23/00 |
| 2022/0282585 | A1* | 9/2022 | Zakharia | E21B 33/1292 |
| 2022/0364430 | A1* | 11/2022 | Knight | E21B 23/04 |

* cited by examiner

DOWNHOLE SETTING ASSEMBLY WITH SWITCH MODULE

CROSS-REFERENCE TO RELATED APPLICATIONS

This application claims benefit of U.S. provisional patent application Ser. No. 63/187,145 filed May 11, 2021, and entitled "Downhole Setting Assembly with Switch Module," which is hereby incorporated herein by reference in its entirety for all purposes.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore with perforating guns along with any casing tubulars disposed therein along a targeted hydrocarbon bearing formation to provide a path for formation fluids (e.g., hydrocarbons) to flow into the wellbore. To enhance the productivity of each of typically a great many perforations, the wellbore is divided into a plurality of production zones along the targeted formation where the perforations associated with each zone are enlarged and expanded by hydraulic fracturing sometimes referred to as "fracking". Each production zone is isolated from the other downhole zones using a sealing device (e.g., a plug, a packer) installed within the wellbore prior to the given production zone being perforated. Generally, both a setting tool and at least one perforating gun assembled along the same tool string are inserted into the wellbore in order to set the sealing device and then perforate the casing in a single trip downhole.

Typically, the sealing device is installed from a downhole end of the tool string using a setting tool and initiator which is sometimes referred to as a "firing head." The setting tool typically includes an explosive or combustible power charge for shifting the sealing device within the wellbore from an initial configuration in which fluid flow is permitted around the sealing device and a set configuration in which the sealing device plugs the wellbore. With the sealing device in the set configuration the setting tool separates from the set sealing device to permit the setting tool to be pulled back to the surface with the rest of the tool string. The firing head or setting tool initiator typically includes a firing head or igniter switch that is connected to a controller at the surface and to the combustible element through an igniter of the firing head. However, it may be understood that a given sealing device is set before any perforations are created uphole from the intended location of the setting of the given sealing device as the ability to effectively frack any of those uphole perforations is undermined by the open and fracked perforations downhole from the given sealing device. Thus, a failure to properly set the sealing device may result in fluid communication between the perforations formed uphole from the sealing device and the fracked perforations located downhole from the sealing device, preventing the operator from successfully fracking the uphole perforations due to diversion of the fracking fluid into the downhole perforations.

Recognizing that the operator at the surface has a high need to know that the sealing device is fully set and sealing off the downhole zones of the wellbore, the operator may confirm that the sealing device has set by slowly reeling in wireline at the wireline truck and observing an increase in tension on the wireline cable at the surface as the sealing device is gripping to the inside of the casing and then a sudden drop in tension on the wireline cable when the setting tool separates from the now set sealing device. If that characteristic tension change in the wireline cable is not observed, then the operator may pump additional fluid downhole and see if more wireline is drawn out which would suggest that the sealing device has not yet set. Conversely, if the sealing device is set, any further liquid pumping would not push the sealing device farther downhole. While these verification techniques provide some degree of confidence, they are time consuming in an operation in which every additional minute results in added costs. Thus, the industry would value a better, faster, cheaper means for confirming that the plug has set before creating more perforations in a wellbore.

SUMMARY

A system for plugging a wellbore extending from the surface and into a subterranean earthen formation is disclosed herein. In an embodiment, the system comprises a plug comprising an annular sealing element and having an initial configuration configured to permit fluid flow around the plug in the wellbore and a set configuration configured to plug the wellbore whereby fluid flow around the plug in the wellbore is restricted, a setting tool configured to couple with the plug and comprising an energetic element, the setting tool configured to shift the plug from the initial configuration to the set configuration in response to ignition of the energetic element, and a setting tool initiator comprising an igniter switch and an igniter, wherein the setting tool initiator is configured to ignite the energetic element of the setting tool in response to ignition of the igniter, wherein the igniter switch has an operational state in which the igniter switch is configured to receive electrical signals from the surface and an inoperable state in which the igniter switch is not configured receive electrical signals from the surface, and wherein the setting tool initiator is configured to shift the igniter switch from the operational state to the inoperable state in response to the ignition of the igniter. In some embodiments, the setting tool initiator is configured to physically disable the igniter switch in response to the ignition of the igniter. In some embodiments, the setting tool initiator is configured to expose the igniter switch to combustion products generated by the igniter in response to the ignition of the igniter. In certain embodiments, the setting tool initiator is configured to permanently shift the igniter switch from the operational state to the inoperable state. In certain embodiments, the setting tool initiator comprises an initiator housing having a switch compartment in which the igniter switch is positioned, and an igniter compartment in which the igniter is located, and wherein a fluid flowpath extends from the igniter compartment to the switch compartment. In certain embodiments, the fluid flowpath is configured to expose the switch compartment to combustion products from the igniter compartment in response to the ignition of the igniter. In some embodiments, the plugging system further comprises a surface controller in signal communication with the igniter switch when the igniter switch is in the operational state and not in signal communication with the igniter switch when the igniter switch is in the inoperable state. In some embodiments, the setting tool initiator further comprises a switch chassis having an interior in which the igniter switch is positioned, and an igniter adapter coupled to the switch chassis and having an interior in which the igniter is positioned. In certain embodiments, the switch chassis positions the igniter switch at a predefined distance from the igniter. In certain embodiments, the setting tool initiator further comprises an igniter spring positioned in the interior of the igniter adapter, wherein the igniter spring electrically connects the igniter switch with the igniter.

A setting tool initiator for actuating a setting tool of a plugging system is disclosed herein. In an embodiment, the setting tool initiator comprises an igniter switch having an operational state in which the igniter switch is configured to receive and transmit electrical signals and an inoperable state in which the igniter switch is not configured to transmit or receive electrical signals, and an igniter ignitable by the igniter switch and configured to actuate the setting tool in response to ignition of the igniter when the setting tool initiator is connected to the setting tool, wherein the setting tool initiator is configured to shift the igniter switch from the operational state to the inoperable state in response to the ignition of the igniter. In some embodiments, the setting tool initiator comprises an initiator housing in which the igniter switch and the igniter are received, a switch chassis positioned in the initiator housing and having an interior in which the igniter switch is positioned, and an igniter adapter positioned in the initiator housing and coupled to the switch chassis, wherein the igniter adapter has an interior in which the igniter is positioned. In some embodiments, the switch chassis positions the igniter switch at a predefined distance from the igniter. In certain embodiments, the predefined distance is 1.75 inches or less. In certain embodiments, the setting tool initiator further comprises an igniter spring positioned in the interior of the igniter adapter, wherein the igniter spring electrically connects the igniter switch with the igniter. In some embodiments, the setting tool initiator comprises an initiator housing in which the igniter switch and the igniter are received, and wherein the initiator housing defines an igniter compartment in which the igniter is positioned and a switch compartment in which the igniter is positioned, wherein a fluid flowpath is formed extending through the initiator housing from the igniter compartment to the switch compartment. In certain embodiments, the initiator housing has a maximum length of 6.5 inches or less. In certain embodiments, the switch compartment has a maximum inner diameter of 1.50 inches or less.

A method for plugging a wellbore extending through a subterranean earthen formation is disclosed herein. In an embodiment, the method comprises (a) deploying a plugging system comprising a plug, a setting tool, and a setting tool initiator into a wellbore extending through a subterranean earthen formation, (b) igniting an igniter of the setting tool initiator in response to transmitting a signal from an igniter switch of the setting tool initiator to the igniter, the igniter switch being electrically connected to a surface controller, (c) igniting an energetic element of the setting tool in response to igniting the igniter of the setting tool initiator, (d) shifting the plug from an initial configuration in which fluid flow is permitted around the plug in the wellbore to a set configuration plugging the wellbore whereby fluid flow around the plug in the wellbore is restricted in response to igniting the energetic element of the setting tool, (e) exposing the igniter switch combustion products from the ignition of the igniter to disconnect the igniter switch from the surface controller. In some embodiments, the method comprises (f) positioning an igniter switch module comprising the igniter switch and the igniter into an initiator housing of the setting tool initiator prior to deploying the plugging system into the wellbore whereby the igniter is positioned in an igniter compartment defined by the initiator housing and the igniter switch is positioned in a switch compartment defined by the initiator housing, wherein (e) comprises circulating the combustion products along a flowpath extending from the igniter compartment to the switch compartment. In some embodiments, the igniter switch module positions the igniter switch at a predefined distance from the igniter. In certain embodiments, the predefined distance is 1.75 inches or less. In some embodiments, (e) comprises physically disabling the igniter switch in response to exposing the igniter switch to the combustion products.

A setting tool for setting a plug is disclosed herein. In an embodiment, the setting tool comprises a setting tool housing having a central passage which defines an initiator compartment configured to receive an initiator for initiating combustion of a combustible element, a combustion compartment configured to receive the combustible element, and a switch compartment configured to at least partially receive a switch circuit for activating the initiator, a piston positionable at least partially in the central passage of the housing and in fluid communication with the combustion compartment, wherein the piston is configured to impart a setting force against the plug in response to combustion of the combustible element, and an interrupt flowpath configured to connect at least one of the combustion compartment and the initiator compartment with the switch compartment whereby combustion products that may be created in the initiator compartment or combustion compartment would be circulated from the at least one of the combustion compartment and the initiator compartment to the switch compartment to disconnect the switch circuit in response to the activation of the initiator charge. In some embodiments, the setting tool comprises an initiator positioned in the initiator compartment. In some embodiments, the setting tool comprises a combustible element positioned in the combustion compartment. In certain embodiments, the setting tool comprises at least a portion of the switch circuit positioned in the switch compartment. In certain embodiments, the switch circuit comprises an initiator switch positioned in the switch compartment and wherein the initiator switch is rendered electrically inoperable in response to exposure to combustion products from the interrupt flowpath.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
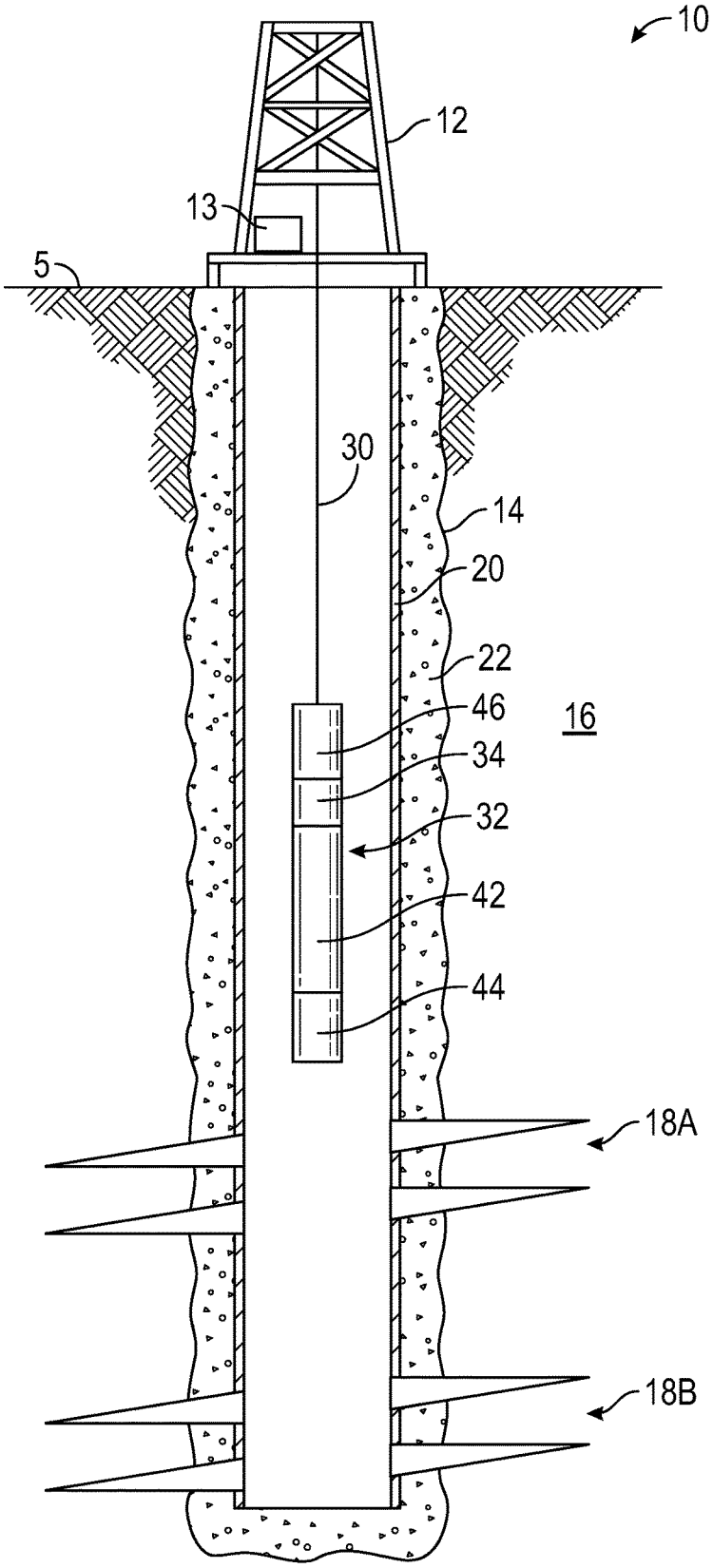
FIG. 1 is a schematic illustration of an embodiment of a system for completing a subterranean well.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection can be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Tools used in completing oil well or gas wells are introduced or carried into a subterranean wellbore on a work string, such as wireline, electric line, continuous coiled tubing, threaded work string, or the like, for engagement at a pre-selected position within the wellbore. The wellbore can be lined with a tubular conduit such as a casing string or liner. The wellbore can be an openhole section where the drilled formation does not have the conduit supporting the drilled formation. The wellbore can include a secondary tubing member, such as production tubing, that is placed within a casing, liner, or openhole section. These completion tools include sealing devices such as expandable elastomeric plugs, permanent or retrievable plugs, bridge plugs, ball seats, packers, production packer, service packer, production sleeve, ball-type and other valves, injectors, perforating guns, tubing hanger, casing hanger, liner hanger, cement plug dropping heads, and other devices typically encountered during the drilling, completion, or remediation of a subterranean well. Such devices and tools will hereafter collectively be referred to as "auxiliary tools." The auxiliary tool is typically set and anchored into position within the casing, tubing, or openhole section such that movements in various directions such as upwardly, downwardly, or rotationally, are resisted, and, in fact, prevented. Such movements can occur as a result of a number of causes, such as pressure differentials across the tool, temperature variances, tubing or other conduit manipulation subsequent to setting for activation of other tools in the well, and the like.

The auxiliary tool typically must be set or actuated to position the auxiliary tool at the required depth within the casing, liner, tubing, or openhole section. In some cases, the auxiliary tool can comprise, for example, a plug or packer including a packing element that will form a seal when energized. As described above, the activation or manipulation of some of such auxiliary tools often is achieved by use of a setting tool which can be introduced into the wellbore along with or subsequent to the auxiliary tool on a work string, such as wire or electric line, continuous or coiled tubing, threaded tubing, drill pipe, or by other known means. In some applications, a setting tool can include one or more pistons to move or stroke a portion of the setting tool relative to stationary portion of the setting tool to apply a setting force in compression or in tension to the auxiliary tool. Pressure can be applied to face of the piston within the setting tool to generate the setting force to set or actuate the auxiliary tool.

Some setting tools utilize an explosive or combustible element or power charge to develop a high pressure gas within a combustion compartment of the setting tool following the ignition of the combustible element. The high pressure generated by the burning or firing of the combustible element may drive a piston, stroking rod, or other member of the setting tool to move relative a stationary member to cause the manipulation of the auxiliary tool. By "burning" or "firing" it is meant the continuous generation, sometimes relatively slowly, of pressure by ignition of a combustible element initiated reaction which results in a pressure increase within a combustion compartment of transmittable gaseous pressure within the apparatus. Sometimes the terms "detonate" and "ignite" are used to describe a sudden generation of gaseous pressure. The terms "detonate", "burning", "igniting," or "firing", all describe the generation of gaseous pressure by the burning of the combustible element with different timescales.

The ignition of the combustible element to burn is started with an igniter of a setting tool initiator or firing head coupled to the setting tool. The igniter can be comprised of a plurality of igniters. For example, the igniter can be a single primary igniter, a primary igniter and secondary igniter, or a primary, secondary, and embedded igniter. The primary igniter can comprise a tube, an electronic ignition device, and a pyrotechnic material that creates a jet of heat and flame. Similarly, the secondary and embedded igniter can be comprised of a pyrotechnic material. The electronic ignition device within the primary igniter can be, for example, any combination of a thermal match, a heater cartridge, an electrical trigger, an electrical igniter, or an electrical arc generator. The pyrotechnic material can be any combination of gunpowder, thermite, or a metal and oxidizer mix. An electrical signal, e.g., a combination of voltage and current, applied to the primary igniter can ignite the pyrotechnic material with the electronic ignition device and produce a heated jet or flame jet extending outwards from the end of the tube as the pyrotechnic material is consumed. The flame jet from the igniter may contact and ignite the combustible element in the combustion compartment.

The setting tool initiator including a setting tool housing can be installed onto the combustion compartment of the setting tool to house the igniter and to electrically communicate with the igniter. The setting tool initiator may also include an igniter switch electrically connected to both the igniter and to a controller located at the surface of the wellbore. In some applications, the igniter can be installed within the initiator housing and threadingly connected to the combustion compartment of the setting tool.

In a typical deployment of a tool string including a conventional setting tool initiator, operator at the surface prepare the tool string for conveyance into the well. The tool string can comprise a work string, the setting tool initiator, a setting tool, and an auxiliary tool. The operator may releasably connect the auxiliary tool to the setting tool, install a combustible element into the combustion compartment of the setting tool, and connect the setting tool initiator igniter to the setting tool. The operator may then then direct the conveyance of the tool sting into the wellbore and convey the tool string through the wellbore to the desired location. The location of the tool string can be verified by any combination of a measured length of the tool string, the number of collars counted by a collar locator, a location device within the wellbore, or by a measurement transferred to surface by the setting tool initiator.

Once at the desired location, the operator may signal the igniter switch of the setting tool initiator to ignite the igniter and activate the setting tool to set the auxiliary tool at the desired location. The operator at surface may not receive any indication that the igniter was initiated by the signal to the igniter switch. In one case, the operator may not know that the setting tool did not function. For example, undetected corrosion or the buildup of carbon around the ignition switch can prevent the signal or weaken the signal sent to the igniter. In another example, the operator may not know that the setting tool did function and set the auxiliary tool. In some shallow wells, the weight of the work string can indicate a change in value (e.g., the tool string weighs less, indicating that the setting tool did function). However, in deeper wells or on floating platforms offshore, there may not be a noticeable change in the weight of the work string. Generally, the work sting cannot be lowered to bump or tag the auxiliary tool as the setting tool could become entangled with the set auxiliary tool in the well resulting in an expensive fishing job to retrieve the stuck tools string. Thus, it is desirable to develop a setting tool initiator that provides feedback to surface that the igniter did activate and ignited the combustible element within the setting tool.

Embodiments described herein include a setting tool initiator that is comprising an igniter switch module is coupled to a combustion compartment of a setting tool. A switch module comprising the igniter switch and the igniter are installed into the setting tool initiator. An operator may signal the igniter switch to initiate the igniter. The igniter produces a flame jet that ignites the combustible element to burn. In this configuration, the igniter switch malfunctions due to the heat and pressure from the burning combustible element filling the setting tool initiator. The operator may register the malfunction igniter switch at surface as an indication that the setting tool has functioned to set the auxiliary tool.

In an embodiment, the setting tool initiator is comprising an igniter switch module is coupled to the combustion compartment of the setting tool. The switch module comprises the igniter switch, a circuit breaker, and the igniter. The circuit breaker can be a thermal switch, pressure switch, or an impact switch. The circuit breaker is electrically connected to the igniter switch and cuts off communication to the igniter switch when a predetermined threshold value is reached. For example, the thermal switch may break communication with the igniter switch when the temperature of the switch exceeds 500 degrees Fahrenheit (° F.). The switch module is installed into the setting tool initiator. The operator may signal the igniter switch to initiate the igniter. The igniter produces a flame jet that ignites the combustible element to burn. The circuit breaker disconnects the igniter switch due to the heat and pressure exceeding a preset value of the circuit breaker from the burning combustible element filling the setting tool initiator. The operator may register the end of communication with the igniter switch at surface as an indication that the setting tool has functioned to set the auxiliary tool.

In an embodiment, the setting tool initiator is comprising an igniter switch module is coupled to the combustion compartment of the setting tool. The switch module comprises the igniter switch, an instrument sensor, and the igniter. The instrument sensor can be an electronic temperature sensor, pressure sensor, an impact sensor, or an acoustic sensor. The instrument sensor communicates data through the switch module to surface via the conductors in the work string. The instrument sensor can communicate data continuously after the signal is sent to the igniter switch. For example, the temperature sensor communicates temperature measurements from inside the setting tool initiator to the operator at surface. In operation, the operator may signal the igniter switch to initiate the igniter. The igniter produces a flame jet that ignites the combustible element to burn. The temperature sensor communicates the temperature measurements to surface via the electrical conductor in the work string. The service personnel monitor the temperature of the setting tool initiator from the surface. An increase in the temperature of the setting tool initiator indicates that the setting tool has functioned to set the auxiliary tool.

The present disclosure describes a setting tool apparatus for use in a wellbore comprising a switch module capable of communicating the switch status to surface after initiating the igniter to power the setting tool to activate a downhole completion tool. The communication by the switch module to the surface personnel indicates the status of the setting tool saving the service personnel time and resources diagnosing the downhole status of the setting tool and downhole completion tool.

Figure 2:
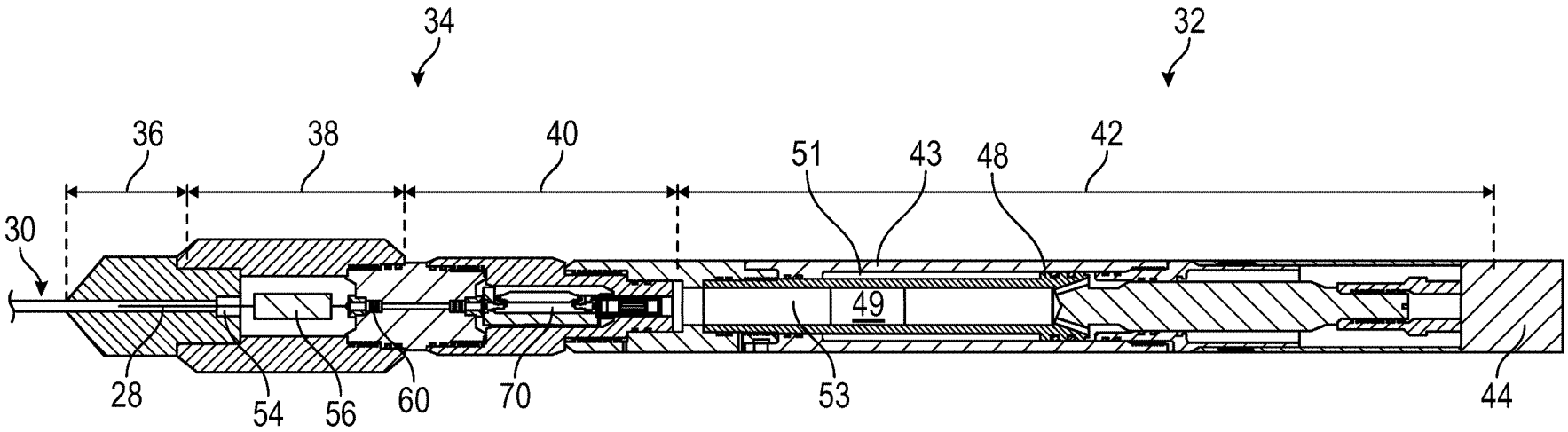
FIG. 2 is a cross-sectional view of an embodiment of a tool string for completing a subterranean well.

Referring now to FIGS. 1 and 2, an embodiment of a system 10 for plugging a wellbore 14 extending from the surface 5 through a subterranean earthen formation 16 is shown. In this exemplary embodiment, plugging system 10 generally includes a surface assembly or servicing rig 12 positioned at the surface 5 that extends over and around the wellbore 14 that penetrates the earthen formation 16 for the purpose of recovering hydrocarbons from a first production zone 18A and a second production zone 18B (collectively the production zones "18". The wellbore 14 can be drilled into the subterranean formation 16 using any suitable drilling technique. While shown as extending vertically from the surface in FIG. 1, the wellbore 14 can also be deviated, horizontal, and/or curved over at least some portions of the wellbore 14. For example, the wellbore 14, or a lateral wellbore drilled off of the wellbore 14, may deviate and remain within one of the production zones 18. The wellbore 14 can be cased, open hole, contain tubing, and can generally be made up of a hole in the ground having a variety of shapes and/or geometries as is known to those of skill in the art. In the illustrated embodiment, a casing 20 can be placed in the wellbore 14 and secured at least in part by cement 22.

The servicing rig 12 of plugging system 10 can be one of a drilling rig, a completion rig, a workover rig, a wireline surface system, or other structure and supports a tool string 32 disposed in the wellbore 14. Servicing rig 12 includes a surface controller 13 in signal communication with one or more downhole tools of tool string 32. In other embodiments, other surface systems or structures can also support the tool string 32. The servicing rig 12 can also comprise a derrick with a rig floor through which the tool string 32 extends downward from the servicing rig 12 into the wellbore 14. It is understood that other mechanical mechanisms, not shown, can control the run-in and withdrawal of the tool string 32 in the wellbore 14.

In this exemplary embodiment, the tool string 32 generally includes a work string 30, a perforating gun 46 (hidden from view in FIG. 2), a signal sub 34, a setting tool initiator, a setting tool 42, and an auxiliary tool 44. It may be understood that in other embodiments the configuration of tool string 32 may vary. For example, in some embodiments, tool string 32 may additionally include a fishneck, one or more weight bars, a release tool, and/or one or more other downhole tools. The work string 30 can be any of a string of jointed pipes, a slickline, a coiled tubing, and a wireline. The auxiliary tool 44 may comprise one or more frac plugs, one or more packers, one or more tubing hangers, one or more completion components such as screens and/or production valves, sensing and/or measuring equipment, and other equipment which are not shown in FIG. 1. The tool string 32 can be lowered into the wellbore 14 to position the setting tool 42 to set or actuate a frac plug at a predetermined depth.

As shown particularly in FIG. 2, in this exemplary embodiment, setting tool 42 generally includes a setting tool housing 43, a piston 48 slidably disposed in the housing 43, and a combustible or explosive element 49 positioned in the setting tool housing 43. Particularly, setting tool housing 43 defines a central passage 51 having a combustion compartment 53 in which the combustible element 49 is received. Piston 48 is configured to impart a setting force against the auxiliary tool 44 in response to combustion of the combustible element 49. While the setting tool initiator 40 is described herein as separate from the setting tool 42, it may be understood that in some embodiments the setting tool initiator 40 may comprise a component of the setting tool 42 with the initiator housing comprising a section (e.g., a section housing) of the setting tool housing 43.

Auxiliary tool 44 is releasably attached to a distal or downhole end of the setting tool 42. In this exemplary embodiment, the signal sub 34 includes any combination of a cable head 36, and an instrument sub 38. The cable head 36 attaches the signal sub 34 to a work string 30 that includes an electrical conductor 28. For example, a wireline can include one or more electrical conductors wrapped with a braided wire. The cable head 36 can electrically connect the one or more electrical conductors 28 to another component of the signal sub 34 as will be described herein. The perforating gun includes one or more explosive shaped charges configured to perforate casing 20 at the desired location in response to receiving, by a gun switch of the perforating gun, a firing signal from the surface controller 13. It may be understood that while only a single perforating gun 46 is shown in FIG. 1, in other embodiments, tool string 32 may include more than one perforating gun 46.

In this exemplary embodiment, signal sub 34 of tool string 32 includes an instrument sub 38 with environmental sensors 56. The instrument sub 38 couples to the cable head 36 with an electrical connection 54. The environmental sensors 56 can include pressure and temperature sensors to measure the pressure and temperature of the wellbore environment, the pressure and temperature of the interior of the instrument sub, or a combination of both. The environmental sensor 56 can include a motion sensor that can be one or more accelerometers. The measurements of the accelerometers can indicate motion of the setting tool 42. The environmental sensor 56 can include a magnetic sensor commonly referred to as a collar locator used to indicate the location of the setting tool initiator within the wellbore 14. In some embodiments, the environmental sensor 56, of instrument sub 38 may only comprise the magnetic sensor. In some embodiments, other components of the tool string 32 such as perforating gun 46 may be positioned between the instrument sub 38 and setting tool 42.

The setting tool initiator 40 may connect to the signal sub 34 with an electrical connector sub 60 configured to provide a sealed electrical connection between the setting tool initiator 40 and the signal sub 34. The upper sealed electrical connection 60 electrically couples the setting tool initiator 40 to the electrical conductors 28 in the work string 30. The upper sealed electrical connection 60 can also provide pressure isolation between the setting tool initiator 40 and components of tool string 32 positioned uphole from setting tool initiator 40 such as, for example, perforating gun 46.

Figure 3:
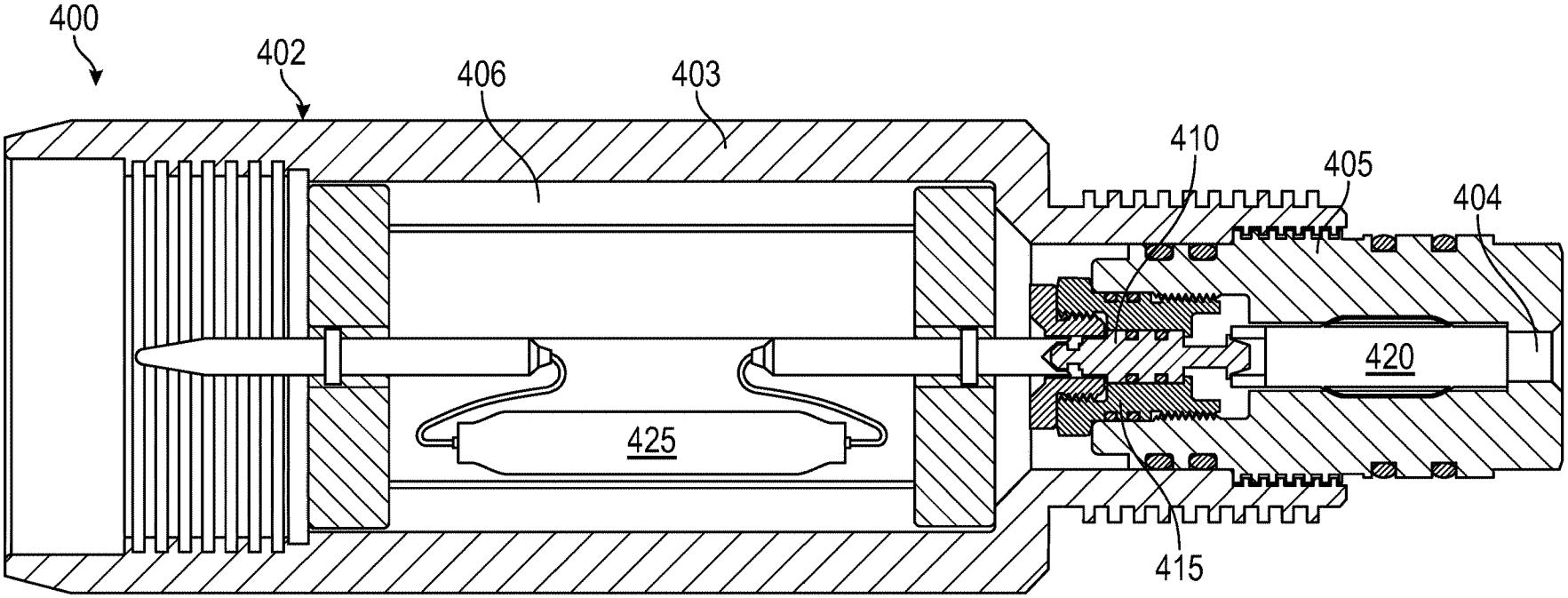
FIG. 3 (Prior Art)
FIG. 3 is a partial cross-sectional view of a conventional setting tool initiator for activating a setting tool.

Turning now to FIG. 3, a conventional setting tool initiator 400 is shown. Setting tool initiator 400 generally includes an initiator housing 402, an igniter 420, and a setting tool igniter switch 425. Initiator housing 402 is shown as including a pair of housing sections 403 and 405 which are connected together to form initiator housing 402. However, it may be understood that initiator housing 402 may comprise only a single housing or more than two housings. Initiator housing 402 defines an internal igniter compartment 404 and an internal switch compartment 406 within the housing 402. The igniter 420 is located in the igniter compartment 404 while the igniter switch 425 is located in the switch compartment 406. The igniter switch 425 is electrically connected to the igniter 420 via an electrical connector located in the initiator housing 402. In this manner, igniter switch 425 may transmit an electrical signal to the igniter 420 through the electrical connector 440 to ignite the igniter 420. The setting tool initiator 400 may thus activate setting tool 42 (not shown in FIG. 3) in response to the ignition of igniter 420.

Conventionally, the igniter 420 is separate from the igniter switch 425 by a bulkhead 415 positioned within initiator housing 402 between the igniter 420 and igniter switch 425. The bulkhead 415 may be separate from or integrated with the electrical connector 410. Conventionally, the bulkhead seals and provides a pressure barrier between the switch compartment 406 and the igniter compartment 404 such that hot and highly pressurized combustion gasses produced by the ignition of igniter 420 are prevented from entering the switch compartment 406 and thereby physically compromising or disabling the igniter switch 425. In this manner, the igniter switch 425 may remain in signal communication with the surface controller 13 following the ignition of igniter 420. For instance, the igniter switch 425 may be used to perform additional actions such as detonating the one or more shaped charges of the perforating gun 46 following the ignition of igniter 420.

While the conventional setting tool initiator 400 is configured to permit igniter switch 425 to survive the ignition of igniter 420, the survival of igniter switch 425 in-turn prevents the destruction or disablement of igniter switch 425 from providing a surface indication to the operator of system 10 that the setting tool 42 has successfully been activated to set the auxiliary tool 44. Instead, the operator at the surface is forced to rely on more time consuming (and hence costly) and less reliable techniques for deciphering whether the auxiliary tool 44 has been successfully set, such as by applying tension to the work string 30 using the servicing rig 12 to determine if the auxiliary tool 44 has anchored against the casing 20. However, as described above, in some applications (e.g., relatively deep wells, offshore applications) it is difficult if not impossible to determine whether the auxiliary tool 44 has been successfully set based on tension applied to the work string 30 as observed at the surface.

It may also be understood that if bulkhead 415 were removed from the conventional setting tool initiator 400 to intentionally compromise igniter switch 425 following the ignition of igniter 420, such a modification would require the combustion products produced by the combustible element of setting tool 42 to fill both the igniter compartment 404 and switch compartment 406. However, the igniter switch 425 is not positioned proximal igniter 420, and the switch compartment 406 has a relatively large volume compared to the volume of igniter compartment 404. The large volume of switch compartment 406, when filled with combustion products produced by the combustible element of setting tool 42, reduces the pressure force imparted by the combustion products against the piston 48 of setting tool 42, concomitantly reducing the setting force applied by the piston 48 of setting tool 42 to the auxiliary tool 44 for setting or actuating the auxiliary tool 44. Particularly, the increased volume occupied by the combustion products in the switch compartment 406 reduces the pressure of the combustion products by increasing the volume the products are permitted to expand into, reducing the effectiveness of the setting tool 42 in setting the auxiliary tool 44 by reducing the pressure force exerted by the setting tool 42 during actuation.

Figure 4:
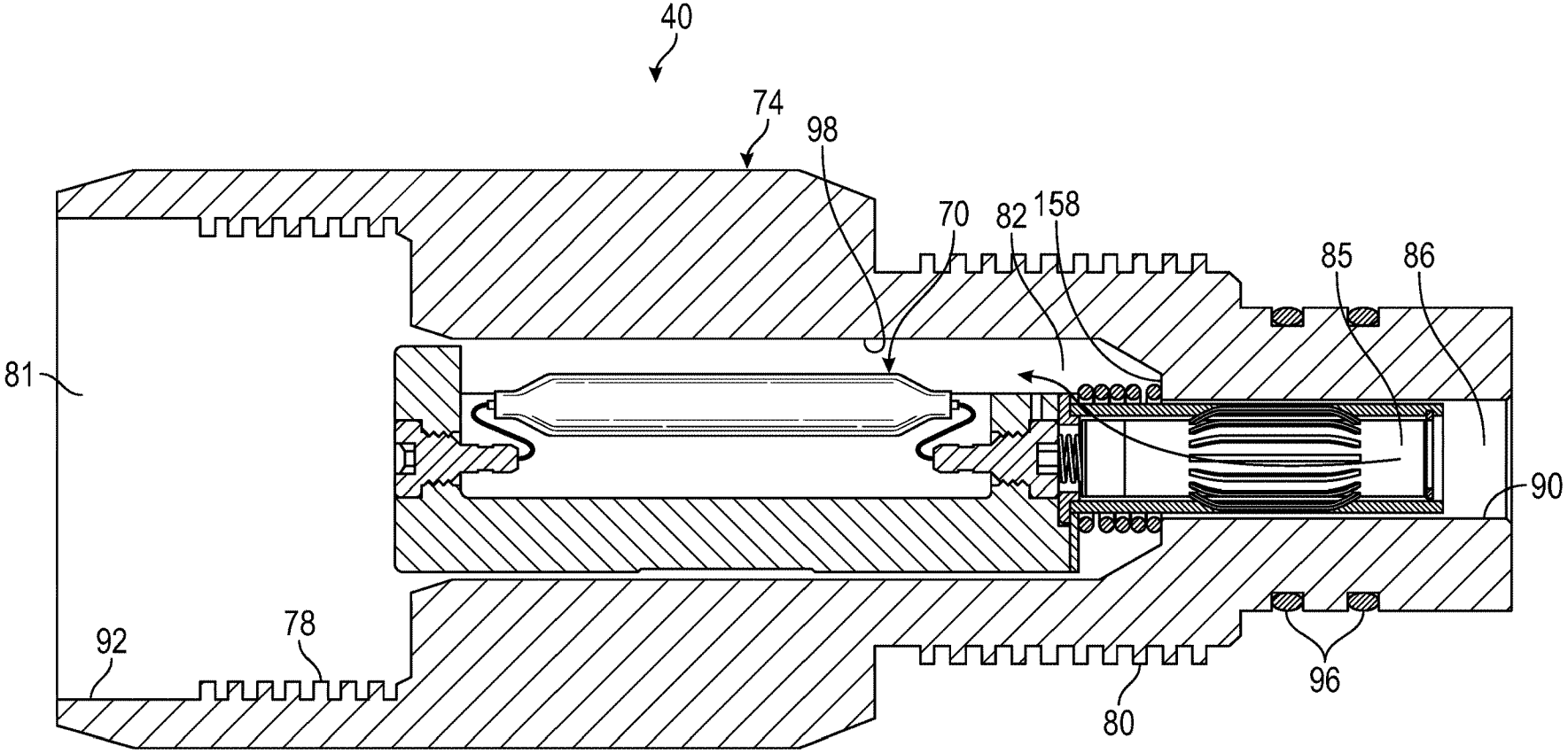
FIG. 4 is a partial cross-sectional view of an igniter switch assembly installed in a setting tool initiator according to an embodiment of the present disclosure.

Turning now to FIG. 4, an embodiment according to the current disclosure of the setting tool initiator 40 is shown. As will be explored in further detail below, unlike conventional setting tool initiator 400 shown in FIG. 3, setting tool initiator 40 of the current disclosure is configured to provide a surface indication of the successful ignition of an igniter 130 of the setting tool initiator 40 by disabling or disconnecting an electrical igniter switch 110 of the setting tool initiator 40. In this exemplary embodiment, setting tool initiator 40 generally includes an initiator housing 74 and an igniter switch module 70. The setting tool initiator 40 may connect with uphole components of tool string 32 (e.g., cable head 36) via the connector sub 60 shown in FIG. 2 and hidden from view in FIG. 4. As will be described further herein, igniter switch module 70 is configured to place igniter switch 110 in close proximity with igniter 130 whereby combustion products may be communicated to the igniter switch 110 while minimizing the amount of additional volume the combustion products must occupy following the ignition of igniter 130. In this manner, igniter switch module 70 permits the compromising of igniter switch 110 to serve as a surface indication of the successful actuation of setting tool 42 while also maximizing the effectiveness of setting tool 42 (by maximizing the pressure force exerted by setting tool 42 during actuation) in setting or actuating the auxiliary tool 44.

In this exemplary embodiment, the initiator housing 74 is a cylindrical shape with an uphole connector 78, a downhole connector 80, and a central bore or passage 81 extending between longitudinally opposed uphole and downhole ends of the initiator housing 74. In this exemplary embodiment, initiator housing 74 comprises a single, integrally or monolithically formed housing and the central passage 81 thereof receives the entirety of the igniter switch module 70. It may be understood however that in other embodiments initiator housing 74 may comprise a plurality of separate sectional housings which are threaded or otherwise connected together end-to-end.

In this exemplary embodiment, central passage 81 of initiator housing 74 includes a switch compartment 82, and an igniter compartment 86 that is connected to the switch compartment 82 by an unabridged interrupt flowpath 85 extending from the igniter compartment 86 to the switch compartment 82. In some embodiments, the interrupt flowpath 85 extends from the combustion compartment 53 and to the switch compartment 82 such that combustion products may be conveyed from the combustion compartment 53 to the switch compartment 82. The switch compartment 82 has an inner housing surface 98, a grounding surface 88, and transitions to the igniter compartment 86. The uphole connector 78 includes an upper seal surface 92 to seal against a corresponding seal assembly of the connector sub 60 to prevent well bore fluids from entering the initiator housing 74. The downhole connector 80 includes a seal assembly 96 configured to seal against a corresponding seal surface defining the combustion compartment 53 of the setting tool 42. The igniter switch module 70 can be installed inside the switch compartment 82 of the initiator housing 74. The igniter attached to the igniter switch module 70 installs into the igniter compartment 86. Initiator housing 74 is configured to minimize the volume of switch compartment 82 such that the volume occupied by the combustion products generated by setting tool 42 during actuation is low enough such that the combustion products may maintain a pressure sufficient to fully set or actuate the auxiliary tool 44. In this exemplary embodiment, the switch compartment 82 has a maximum inner diameter of 1.50 inches (in) or less to thereby minimize the volume of switch compartment 82; however, it may be understood that the maximum inner diameter of switch compartment 82 may vary in other embodiments.

Figure 5:
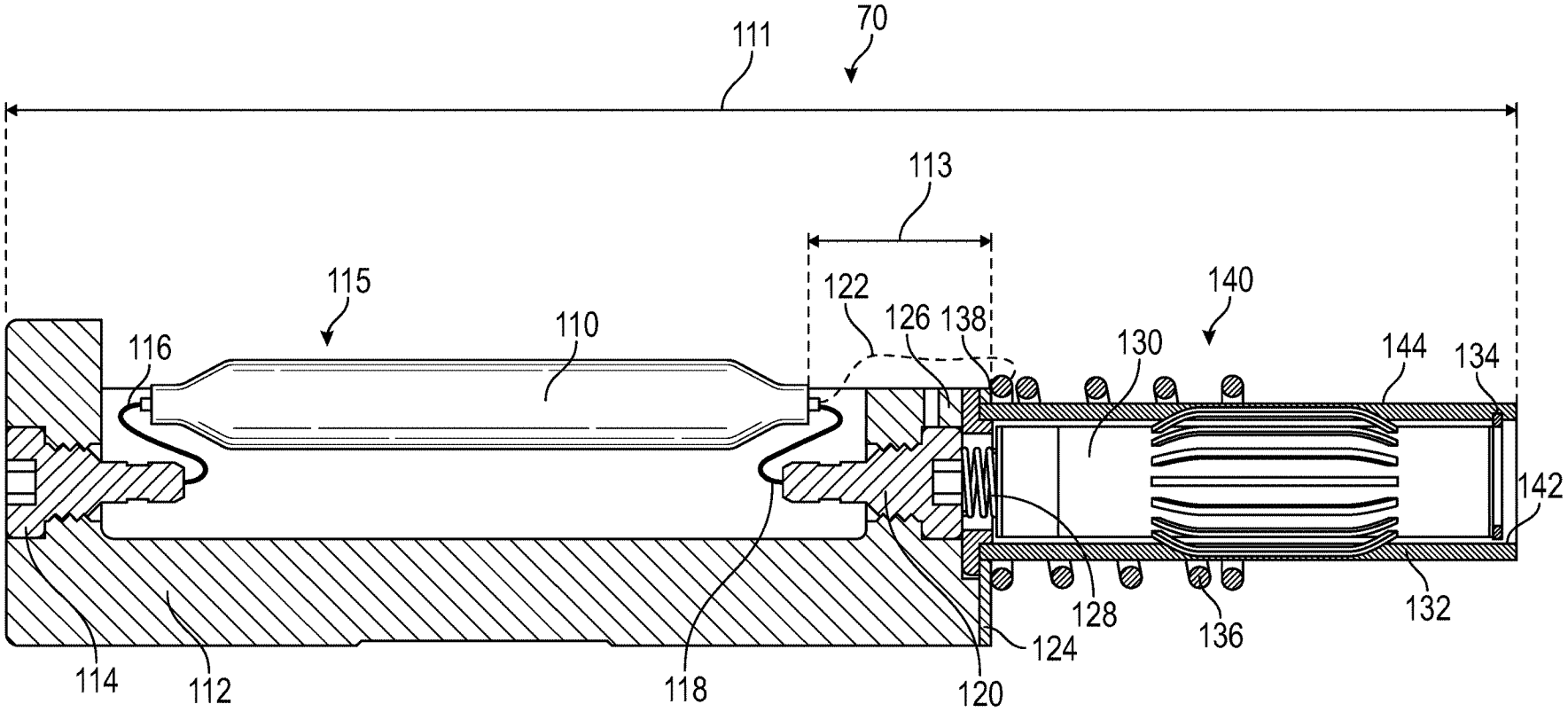
FIG. 5 is a partial cross-sectional view of an igniter switch assembly according to an embodiment of the present disclosure.

The igniter switch module 70 can be tested by the operator for electric connectivity before being installed into the switch compartment 82. As an example, the operator may measure electrical resistance of the igniter 130 after being installed into the igniter switch module 70 by contacting a first lead of a resistance meter to downhole electrical contact 120 and contacting a second lead of the meter to tube 132. Turning now to FIG. 5, in this exemplary embodiment, the igniter switch module 70 generally includes a main body or switch chassis 112, igniter switch 110, an igniter adapter 140, and igniter 130. Igniter switch module 70 allows for the igniter switch 110 and igniter 130 to be pre-connected and installed together as a single unit into the initiator housing 74. As described above, igniter switch module 70 places the igniter switch 110 into close proximity with the igniter 130 so as to maximize the effectiveness of setting tool 42 during actuation. The igniter switch module 70 has a maximum length 111 extending from an uphole end of the switch chassis 112 to a downhole end of the igniter adapter 140. In this exemplary embodiment, the maximum length 111 of igniter switch module 70 is approximately 6.5 in or less;

however, it may be understood that the maximum length 111 of igniter switch module 70 may vary in other embodiments.

The switch chassis 112 of igniter switch module 70 may be made of a non-electrically conductive material (e.g., plastic) such as glass filled nylon. Switch chassis 112 has an uphole electrical contact 114 and a downhole electrical contact 120 for communicating signals to the igniter 130 as will be disclosed further herein. In this exemplary embodiment, igniter adapter 140 includes a tube 132, a flange 124, and a ground or flange spring 136. The tube 132 may be connected or attached to a flange 124 by a weld 138, by fasteners, or by other means. Flange spring 136 may be connected or attached to the flange 124 by a weld 138, by a bent tab, by fasteners, or by other means.

In this exemplary embodiment, igniter switch module 70 additionally includes an igniter spring 128 and a shoulder washer 126. Igniter spring 128 and shoulder washer 126 are installed between the switch chassis 112 and the igniter adapter 140. Tube 132 comprises one or more tabs that bend outwards to secure the tube 132 to the switch chassis 112 and to secure the flange spring 136. The igniter adapter 140 may be attached to the switch chassis 112 with fasteners such as screws. In this exemplary embodiment, igniter 130 is installed into the tube 132 of the igniter adapter 140 and secured in place with a snap ring 134 or any other suitable fastener. Igniter switch 110 is connected to the uphole electrical contact 114 with an uphole switch wire 116. Additionally, igniter switch 110 is connected to the downhole electrical contact 120 with a downhole switch wire 118. A grounding wire 122 from the igniter switch 110 may be connected to a screw or similar location on the front of the igniter adapter 140. The uphole switch wire 116, downhole switch wire 118, and igniter switch 110 collectively form a switch circuit 115 (shown in FIG. 5) which is electrically disconnected in response to the circulation of combustion products to the switch compartment 82 and the concomitant exposure of the switch circuit 115 to the combustion products. For example, one or more of the wires 116 and 118 and igniter switch 110 may be physically compromised following circulation of the combustion products to the switch compartment 82. Additionally, while in this exemplary embodiment the igniter switch 110 is positioned in the switch compartment 82, in other embodiments, igniter switch 110 may be positioned external the switch compartment 82 with another portion of the switch circuit 115 (e.g., downhole switch wire 118) positioned in the switch compartment 82.

The igniter switch 110 has an operational state in which the igniter switch 110 is configured to receive electrical signals from the surface 5 and an inoperable state in which the igniter switch 110 is not configured to receive electrical signals from the surface 5. Setting tool initiator 40 is configured to shift igniter switch 110 from the operational state to the inoperable state in response to the ignition of the igniter 130 which results in the communication of combustion products to the switch chamber 82. For example, the igniter switch 110 may be shifted to the inoperable state by rendering electrically inoperable (e.g., physically compromising) the igniter switch 110 itself or another component of the switch circuit 115 such as uphole switch wire 116.

Igniter switch module 70 positions the igniter switch 110 at a predefined distance 113 from the igniter 130, where the predefined distance is contingent or based on the length of the switch chassis 112, and the length of igniter switch 128 when compressed by the igniter 130. It may be understood that a limited degree of movement may be permitted between igniter switch 110 and igniter 130 and thus the predefined distance 113 may comprise a predefined range. For example, in some embodiments, the predefined distance 113 is approximately 1.75 in or less; however, it may be understood that in other embodiments the predefined distance 113 may vary.

Signals transmitted from an operator at the surface can be communicated to the igniter 130 as will be described herein. For example, the operator may transmit an igniter signal down the electrical conductor 28 within the work string 30 to the tool string 32 shown in FIG. 2. The igniter signal is communicated from the electrical conductor 28 within the work string 30, through the electrical contacts within the signal sub 34, and to the setting tool initiator 40 shown in FIG. 4 via the connector sub 60. From connector sub 60, the igniter signal travels to the igniter switch module 70. The transmitted signal passes through the uphole contact 114 and, the uphole switch wire 116, and to the igniter switch 110. In some embodiments, the igniter switch 110 comprises an addressable switch, including, for example, a printed circuit board, a processor (e.g., a microprocessor or central processing unit (CPU)), and a memory device including instructions stored therein defining the operation of igniter switch 110. The igniter switch 110 has an operational state or configuration in which the igniter switch can receive signals transmitted from surface. For example, when in the operational state, igniter switch 110 may identify an address and a command within the signal, compare the transmitted address to the programmed address within the memory of the igniter switch 110, and execute the command if the transmitted address matches the address in memory. If the transmitted address matches the address in memory, a firing circuit of the igniter switch 110 is opened and permits the voltage and current to be provided to the igniter 130 via the downhole switch wire 118, the downhole contact 120, and the igniter spring 128. As will be discussed further herein, igniter switch 110 additionally includes a disabled or compromised state or configuration in which the switch 110 is not configured to receive signals transmitted from the surface. For example, in the disabled state the igniter switch 110 may be damaged or otherwise physically compromised. As another example, in the disabled state, the circuit connecting igniter switch 110 to the surface controller 13 may be physically damaged or otherwise compromised. It may also be understood that in other embodiments the configuration of igniter switch 110 may vary. For example, in other embodiments, igniter switch 110 may comprise a diode-based switch and may not include a processor or a memory device.

The igniter 130 is grounded to the igniter adapter 140 via biasing members or springs integral to the body of the igniter 130 that contact the inner surface 142 of the tube 132 of the igniter adapter 140. The igniter adapter 140 is grounded to initiator housing 74 of the setting tool initiator 40, as shown in FIG. 4, via the flange spring 136 in contact with the grounding surface 88 of the initiator housing 74. The igniter switch 110 may also be grounded to the grounding surface 88 of the initiator housing 74 via grounding wire 122 that is connected to the igniter adapter 140.

The igniter 130 ignites in response to the igniter switch 110 conveying the signal (e.g., the necessary voltage and current) necessary to initiate the pyrotechnic material of the igniter 130. The resultant flame jets out of the downhole end of the igniter 130 to ignite the combustible element 49 within the combustion compartment 53 of the setting tool 42. The burning or detonation of the combustible element 49 creates a high pressure and high temperature gaseous pressure within the combustion compartment 53 that strokes the piston 48 of the setting tool 42 to set or actuate the auxiliary tool 44. The high pressure and high temperature gases pass between the outer surface 74 of the tube 132 on the igniter adapter 140 and the inner surface 90 of the igniter compartment 86 of the initiator housing 74 to fill the switch compartment 82 of the setting tool initiator 40. In this manner, the environment within the switch compartment 82 of the setting tool initiator 40 changes from a pressure near atmospheric pressure (e.g., 14.7 psi) to a substantially elevated pressure (e.g., a pressure exceeding 10,000 pounds per square inch (PSI)).

As a result of ignition, the igniter switch 110 short circuits, e.g., creates an open circuit, due the change in environmental conditions within the switch compartment 82, e.g., high pressure and high temperature of the gases within the switch compartment 82. Hot pressurized combustion products generated by the ignition of igniter 130 and of the combustible element 49 of the setting tool 42 (the combustible element 49 being in fluid communication with igniter 130) are communicated or flow along flowpath 85 shown in FIG. 4 from the igniter compartment 86 to the switch compartment 82 where the combustion products contact the igniter switch 110 and shift the igniter switch 110 from the operational state to the disabled state. Particularly, the combustion products physically damage or otherwise compromise the physical integrity of igniter switch 110 and/or other circuitry connected thereto (e.g., uphole switch wire 116) whereby igniter switch 110 is no longer connected to surface controller 13 or configured to send or receive signals.

The operator at surface may register the short circuit, i.e., end of communication, as a positive and mechanical surface indication that the combustible element 49 within the setting tool 42 has burned and actuated the setting tool 42 to activate the auxiliary tool 44. In this manner, the operator need not rely on the unreliable practice of applying tension to work string 30 at the surface to determine whether the auxiliary tool 44 has been set. Moreover, igniter switch module 70 places the combustible element 49 and particularly igniter 130 into close proximity with igniter switch 110, thereby ensuring the destruction of igniter switch 110 while minimizing the volume of the central passage 81 of initiator housing 74 and thus the volume which is occupied by the combustion products following the ignition of the igniter 130. Minimizing the volume occupied by the combustion products generated by the ignition of igniter 130 and the combustible element 49 maximizes the pressure force imparted by the combustion products to the piston 48 of the setting tool 42 which strokes in response to the ignition of the igniter 130. The minimization of the volume of central passage 81 may thus assist in ensuring the piston 48 of setting tool 42 fully strokes to thereby fully and successfully set the auxiliary tool 44.

Figure 6:
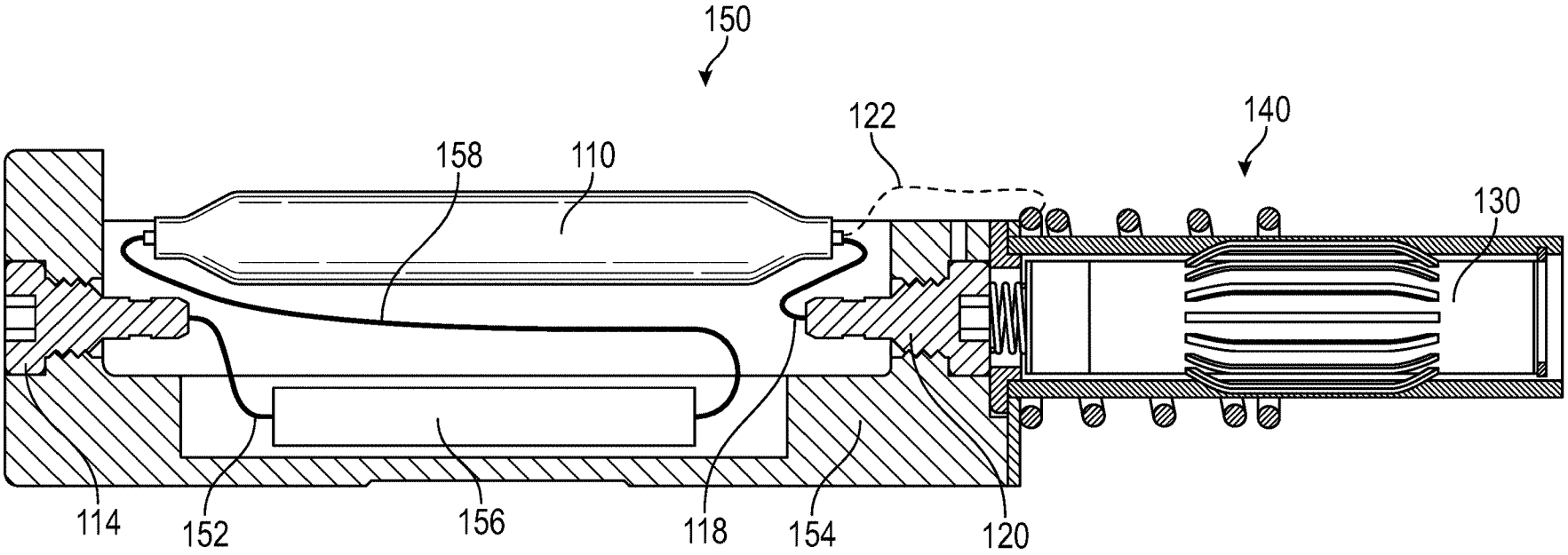
FIG. 6 is a partial cross-sectional view of an igniter switch assembly according to another embodiment of the present disclosure.

In an embodiment, a circuit breaker in the igniter switch module 70 disconnects the communication path to the igniter switch 110. Turning now to FIG. 6, in this embodiment, an igniter switch module 80 comprises the igniter switch 110, a main body 154 housing the igniter switch 110, a circuit breaker 156, the igniter adapter 140, and the igniter 130. The circuit breaker 156 can be a thermal switch, pressure switch, or an impact switch. The circuit breaker 156 is electrically connected within the circuit between the uphole contact 114 and the igniter switch 110. An electronic signal transmitted from surface controller 13 is communicated through the electrical conductor 28 in the work string 30, through the signal sub 34, and to the uphole contact 114 on the igniter switch module 80. In this exemplary embodiment, the signal from surface controller 13 passes through the uphole contact, a second switch wire 82, the circuit breaker 156, the uphole switch wire 88, to the igniter switch 110. The electronic signal from surface controller 13 may pass through the circuit breaker 156 until a predetermined value is reached and the circuit breaker 156 cuts off communication to the igniter switch. If the circuit breaker 156 is a thermal switch, the thermal switch breaks communication with the igniter switch 110 when the temperature exceeds a predetermined value (e.g., 500 degrees Fahrenheit (° F.). If the circuit breaker 156 is an impact switch, the impact switch (i.e., accelerometer) breaks communication with the igniter switch 110 when the impact force (i.e., acceleration) exceeds a predetermined value (e.g., 10 g).

In this exemplary embodiment, when the surface controller 13 transmits an electronic signal to the igniter switch 110 and the transmitted address matches the address in memory, the igniter switch 110 opens the firing circuit thereof to permit the transmission of the voltage and current to the igniter 130 via the downhole switch wire 118, the downhole contact 120, and the igniter spring 128. The igniter 130 ignites and the resultant flame jets out to ignite the combustible element 49 within the combustion compartment 53 of the setting tool 42. The burning or detonation of the combustible element 49 creates a high pressure and high temperature gaseous pressure within the combustion compartment 53 that strokes the piston 48 on the setting tool 42 to set or actuate the auxiliary tool 44. The high pressure and high temperature gases pass between the outer surface 74 of the tube 132 on the igniter adapter 140 and the inner surface 90 of the igniter compartment 86 of the initiator housing 74 to fill the switch compartment 82 of the setting tool initiator 40. The circuit breaker 156 disconnects or breaks communication with the igniter switch 110 when a predetermined value is reached or exceeded. For example, if the circuit breaker 156 is a pressure switch, the pressure switch breaks communication with the igniter switch 110 when the pressure exceeds a predetermined value (e.g., 10,000 PSI). The operator may register the end of communication, or a break in communication, with the igniter switch 110 at surface controller 13 as an indication that the setting tool 42 has functioned to set the auxiliary tool 44.

Figure 7:
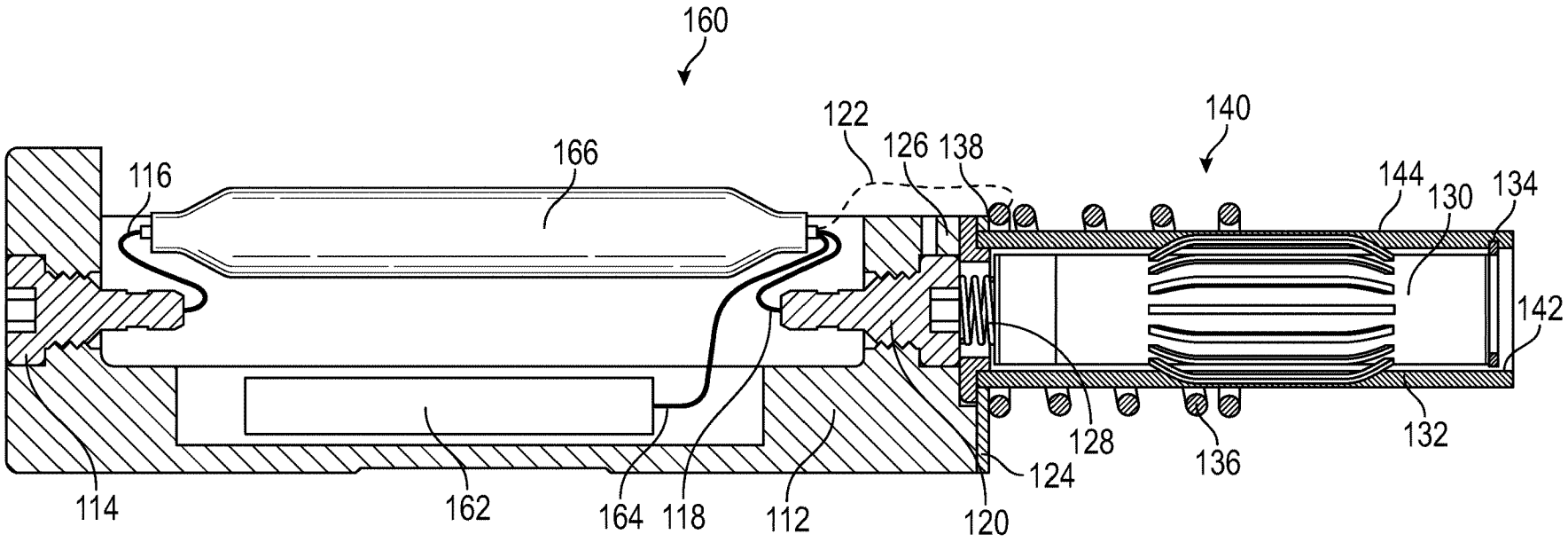
FIG. 7 is a partial cross-sectional view of an igniter switch assembly according to still another embodiment of the present disclosure.
Figure 8:
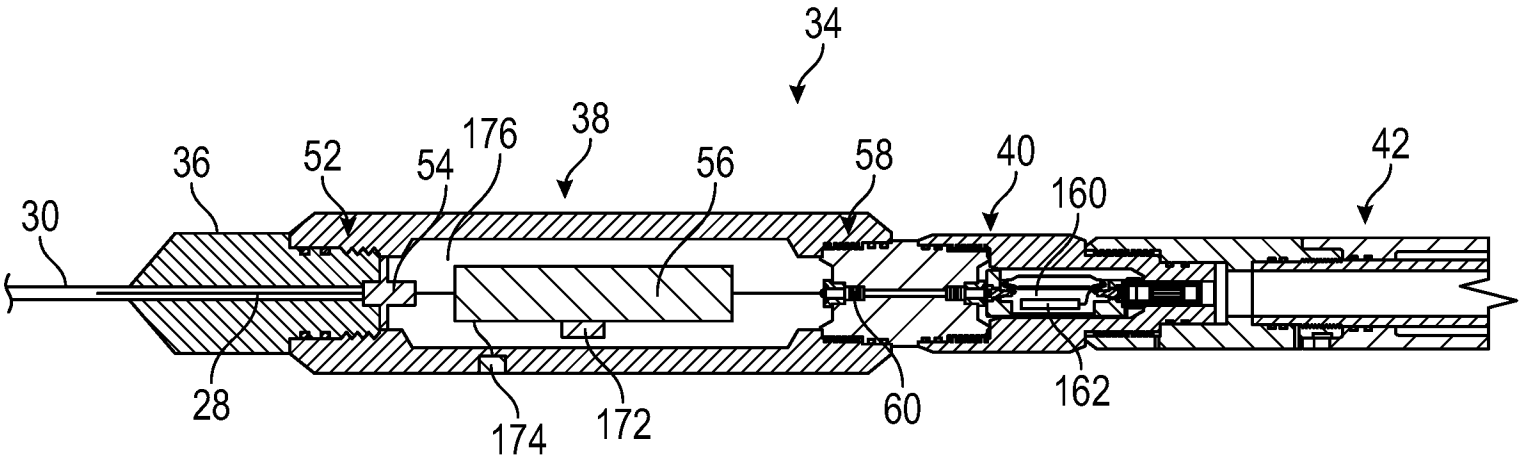
FIG. 8 is a cross-sectional view of a signal sub according to an embodiment of the present disclosure.

In an embodiment, an environmental sensor within the switch module indicates the setting tool 42 has functioned. Turning to FIG. 7, in this embodiment, an igniter switch module 160 comprises the igniter switch 166, an environmental sensor 162, the igniter adapter 140, and the igniter 130. The environmental sensor 162 can be a thermometer, a pressure transducer, an accelerometer, or an acoustic sensor. The igniter switch module 160 can have any combination of one or more environment sensors 162. The environmental sensors 162 are electrically connected to the igniter switch 166 with a sensor wire 164. In this exemplary embodiment, an electronic signal transmitted from surface controller 13 is communicated through the electrical conductor 28 in the work string 30, through the signal sub 34, and to the uphole contact 114 on the igniter switch module 160. The signal transmitted from surface controller 13 passes through the uphole contact 114, the uphole switch wire 116, to the igniter switch 166. As previously described, the igniter switch 166 can be an addressable switch. Likewise, the one or more environmental sensors 162 can be addressable through the addressable igniter switch 166.

An electronic signal from surface controller 13 can command the igniter switch 166 to transmit one or more measurements at a predetermined periodic rate from the environmental sensors 162. For example, the environmental sensor 162 can be a temperature sensor (e.g., thermocouple) that measures the temperature within the switch compartment 82 of the initiator housing 74. For example, the environmental sensor 162 can be a pressure sensor (e.g., pressure transducer) that measures the pressure within the switch compartment 82 of the initiator housing 74. As another example, the environmental sensor 162 can be an accelerometer that measures the acceleration (e.g., motion) of the initiator housing 74. As another example, the environmental sensor 162 can be an acoustic sensor (e.g., microphone, piezoelectric transducer) that measures the acoustic waves or sound levels within the switch compartment 82 of the initiator housing 74. The surface controller 13 may transmit an electronic signal with a command to activate to the igniter 130 and a second command to transmit the measurements at a predetermined periodic rate from the environmental sensor 162.

When the igniter switch 110 receives the commands, the igniter switch 110 transmits a signal (e.g., a predetermined voltage and current) to the igniter 130 via the downhole switch wire 118, the downhole contact 120, and the igniter spring 128. The igniter switch 166 can measure and transmit the measured data from the one or more environmental sensors 162. The igniter 130 ignites and the resultant flame jets out the distal end to ignite the combustible element 49 within the combustion compartment 53 of the setting tool 42. The burning or detonation of the combustible element 49 creates a high pressure and high temperature gaseous pressure within the combustion compartment 53 that strokes the piston 48 of the setting tool 42 to set or actuate the auxiliary tool 44. The service personnel receive the transmitted data from the one or more environmental sensors 162. The change of measured data, for example an increase in the temperature, observed at surface can indicate that the setting tool 42 has functioned to set the auxiliary tool 44.

In an embodiment, the signal sub 34 has a plurality of environmental sensors in two or more locations that provide feedback to the operator at the surface that the setting tool 42 has functioned to set or activate an auxiliary tool 44. The setting tool initiator 40 can include the igniter switch module 160 with one or more environmental sensors 162. The instrument sub 38 can include one or more environmental sensors 56. The environmental sensors can have an internal sensor 172, an external sensor 174, or any combination thereof. The internal sensor 172 can provide measurements at a predetermined periodic rate of the environment inside the instrument compartment 176. The external sensor 174 can provide measurements at a predetermined periodic rate of the wellbore environment exterior of the instrument sub 38. The environmental sensor 56 can be one or more of a temperature sensor, a pressure transducer, an accelerometer, a magnetic sensor, or an acoustic sensor. The environmental sensor 56 can include pressure and temperature sensors to measure the pressure and temperature of the wellbore environment, the pressure and temperature of the instrument compartment 176 of the instrument sub 38, or any combination thereof. The environmental sensor 56 can include a motion sensor that can be one or more accelerometers. The measurements of the accelerometers can indicate motion of the setting tool. The environmental sensor 56 can include a magnetic sensor commonly referred to as a collar locator. The magnetic sensor measures the magnetic response of the casing, liner, or tubing. The collars that connect the casing, liner, or tubing have a different magnetic signature than the tubing bodies. The collar locator measures and counts the collars. The number of collars counted can be correlated to a tubing tally to indicate the location of the setting tool initiator within the wellbore. The environmental sensor 56 can include an acoustic sensor (e.g., microphone, piezoelectric transducer) that measures the acoustic waves or sound levels within the instrument compartment 176 of the instrument sub 38 or the acoustic waves external to the instrument sub 38.

As previously described, the surface controller 13 transmit a signal to the igniter switch module 160 to ignite the igniter 130 and subsequently ignite the combustible element 49 in the setting tool 42. The surface controller 13 can also transmit a signal to the environmental sensor 162 on the igniter switch module 160 and the environmental sensor 56 within the instrument sub 38. The environmental sensor 162 and environmental sensor 56 can measure at a predetermined periodic rate and transmit the measurements to service personnel at surface. Any combination of measured data from the instrument sub 38 or the igniter switch module 160 observed at surface by the operator can indicate the that the setting tool 42 has set the auxiliary tool 44. For example, an increase in the temperature measured by the environmental sensor 162 within the igniter switch module 160 along with motion measured by the environmental sensor 56 within the instrument sub 38 can indicate that the setting tool 42 has functioned to set the auxiliary tool 44.

In an embodiment, the signal sub 34 can comprise an instrument sub 38 with one or more environmental sensors 56, and the setting tool initiator 40 may include circuit breaker 156. As previously described, the surface controller 13 can transmit a signal to the igniter switch module 160 to ignite the igniter 130 and subsequently ignite the combustible element 49 in the setting tool 42. The service personnel can also transmit a signal to the environmental sensor 56 within the instrument sub 38. The environmental sensor 56 can measure at a predetermined periodic rate and transmit the measurements to the operator at surface. The operator can monitor communication with the igniter switch module 160 within the setting tool initiator 40. The circuit breaker 156 will end electrical communication with the igniter switch module 160 when a predetermined environmental condition is met. Any combination of measured data from the instrument sub 38 or loss of electrical communication with the igniter switch module 160 observed at surface by the operator can indicate the that the setting tool 42 has set the auxiliary tool 44.

Figure 9:
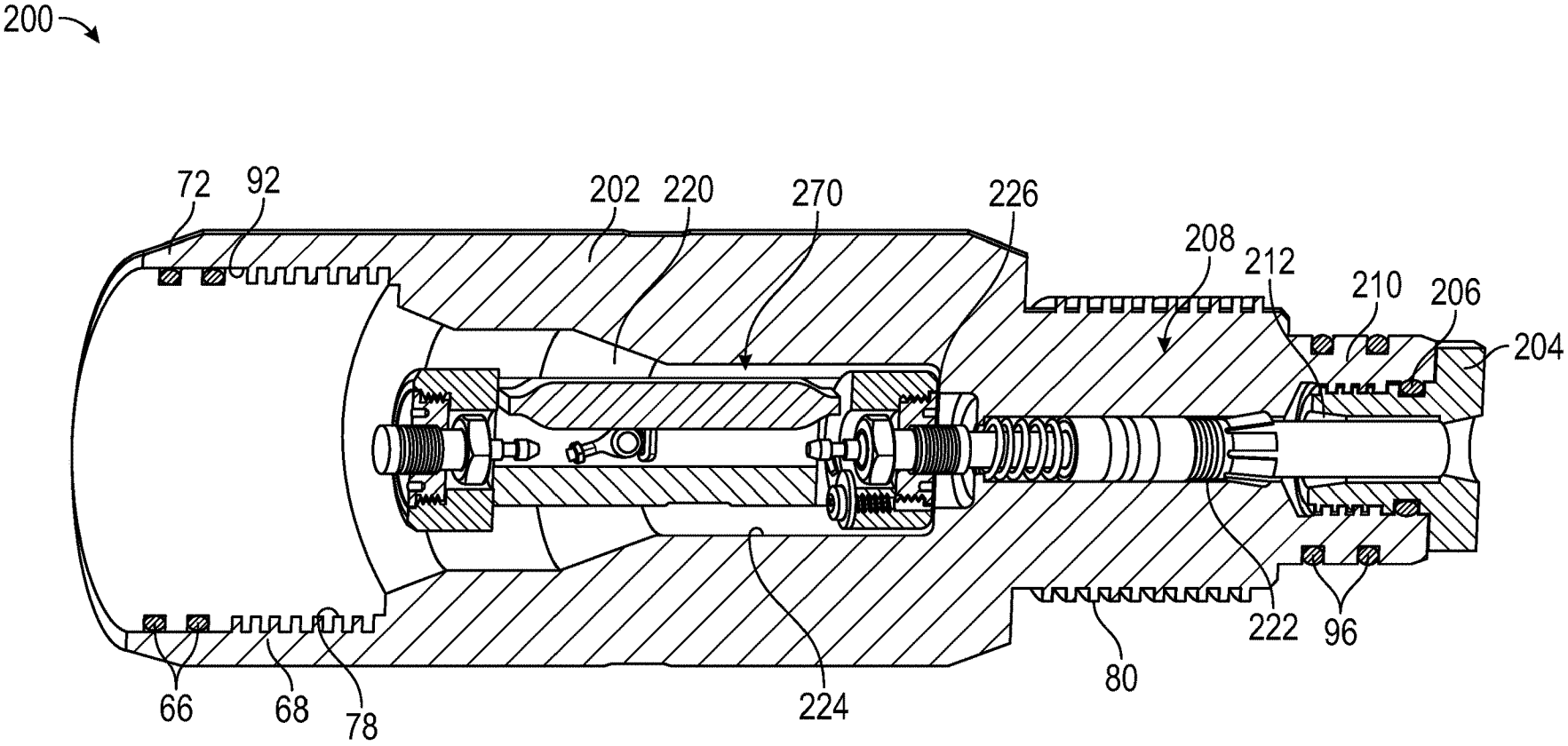
FIG. 9 is a partial cross-sectional view of an igniter switch assembly installed in a setting tool initiator according to another embodiment of the present disclosure.

The pressure within the combustion compartment 53 of the setting tool 42 after the combustible element 49 is ignited can actuate a piston 48 to ground out the igniter switch assembly. In an embodiment shown in FIG. 9, the setting tool initiator 200 includes a movable isolator that grounds out the igniter switch assembly. In this exemplary embodiment, the setting tool initiator 200 generally includes a switch housing 202, an igniter retainer 204, a movable isolator 208, and an igniter switch module 270. The switch housing 202 is a cylindrical shape with an uphole connector 78, a downhole connector 80, an inner thread 212, a switch compartment 220, and an igniter compartment 222 connected to the switch compartment 220 by an uninterrupted fluid flowpath. In this exemplary embodiment, the switch compartment 220 has an inner housing surface 224, and an isolator port 226. The uphole connector 78 includes an upper seal surface 92. The downhole connector 80 includes a lower seal assembly 96. The housing connector 72 sealingly couples to the switch housing 202 to form a seal to prevent well bore fluids from entering the switch compartment 220. The downhole connector 80 and seal assembly couple the setting tool initiator 200 to the combustion compartment 53 of the setting tool 42. The installation of the igniter switch module 270 and the igniter will be explained in more detail herein.

Figure 10:
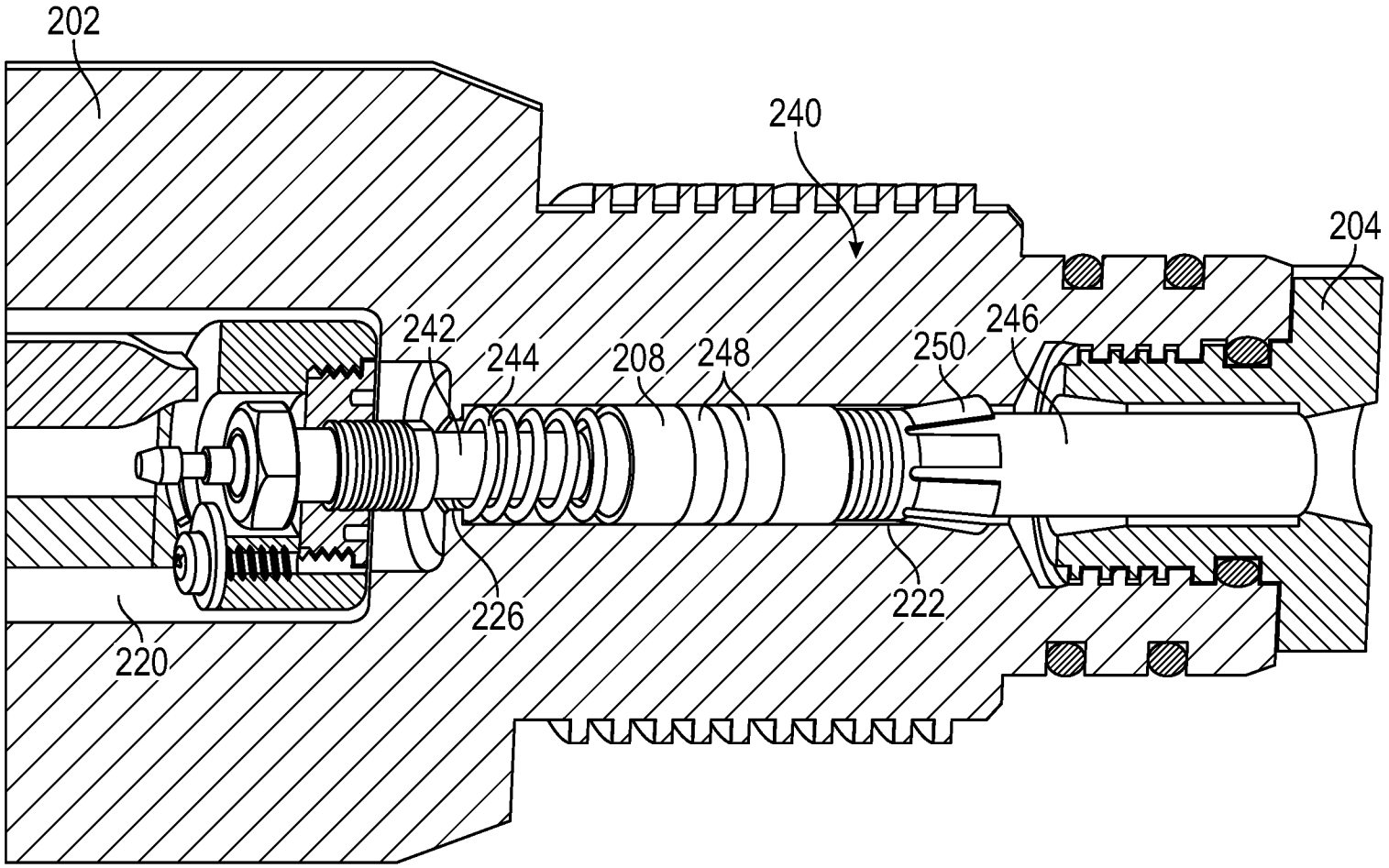
FIG. 10 is a partial cross-sectional view of an igniter assembly installed in a setting tool initiator according to an embodiment of the present disclosure.

Turning to FIG. 10, the igniter assembly 240 can be installed into the igniter compartment 222. In this exemplary embodiment, the igniter assembly 240 generally include an insulated pin connector 242, a retaining spring 244, movable isolator 208, and an igniter 246. The insulated pin connector 242 and movable isolator have an electrically conductive core to communicate electrical signals to the igniter 246. The insulated pin connector 242 has an outer shell of insulating material. The movable isolator has a seal assembly 248 that can comprise one or more seals with various seal retaining structures. The igniter 246 includes a grounding spring 250 that electrically couples to the igniter compartment 222 of the switch housing 202. The insulated pin connector 242 is coupled to the movable isolator 208 by threads, fasteners, welding, or similar joining methods. The retaining spring 244 can be installed over the insulated pin connector 242 and movable isolator 208. The retaining spring 244, insulated pin connector 242, and movable isolator 208 with seal assembly 248 can be installed into the igniter compartment 222. The igniter 246 can be installed into the igniter compartment 222 and retained with the igniter retainer 204.

Figure 11:
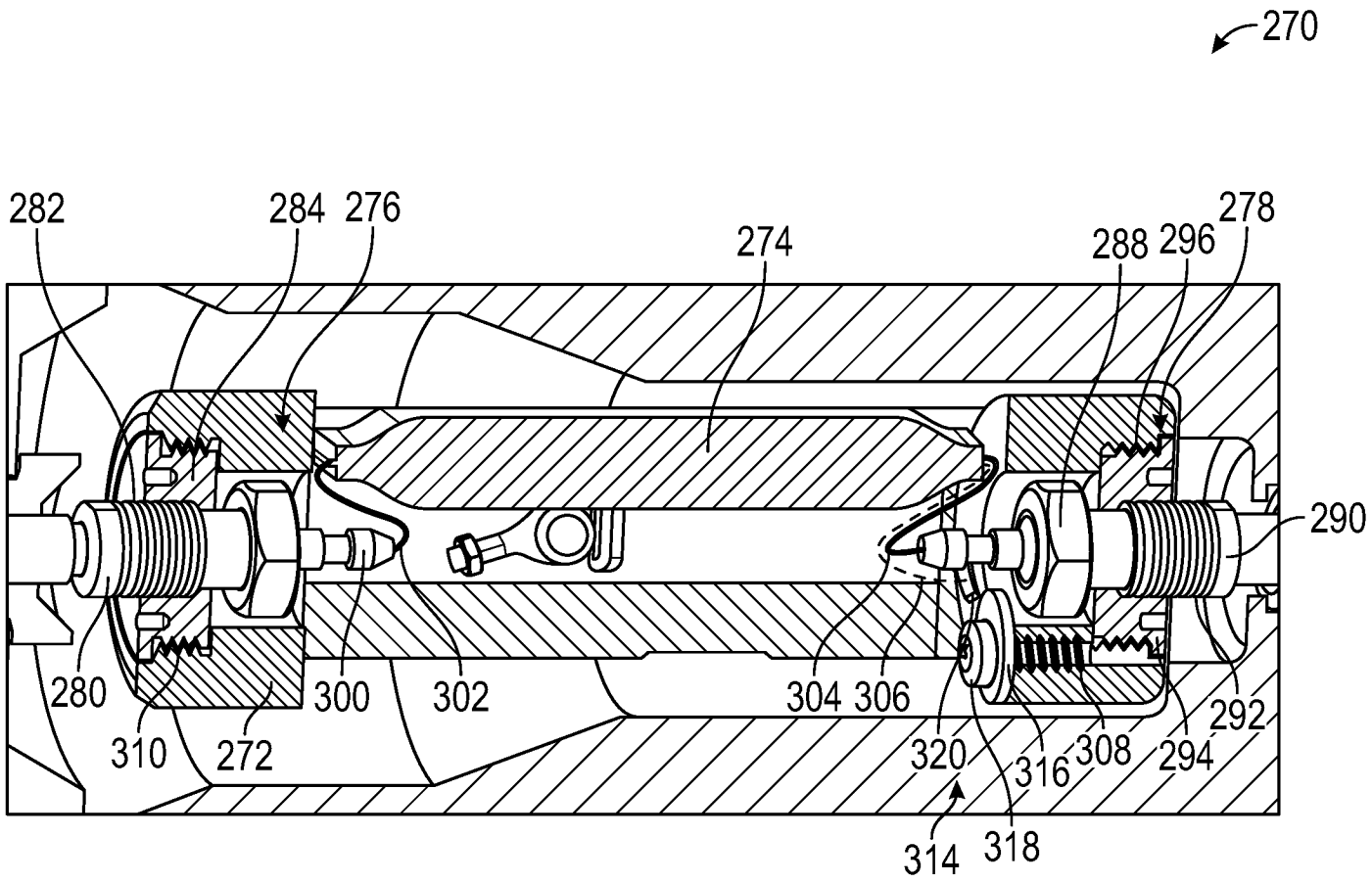
FIG. 11 is a partial cross-sectional view of an igniter switch assembly according to a further embodiment of the present disclosure.

The igniter switch module can be tested by the operator for electric conductivity before being installed into the setting tool initiator. Turning now to FIG. 11, the igniter switch module 270 can comprise, a main body 272, an igniter switch 274, an upper pin assembly 276, a lower pin assembly 278, and a grounding point assembly. The main body 272 can be made of a non-electrically conductive material (e.g., plastic) such as a glass filled nylon. The upper pin assembly 276 comprises a pin connector 300, a connector post 280, a connector spring 282, and a spring retainer 284. The connector spring 282 and spring retainer 284 slidingly fit over the connector post 280 with an allowance fit. The pin connector 300 can couple to the connector post 280 with threads, fasteners, or any other method of joining. The upper pin assembly 276 can threadingly connect to the main body 272 with a threaded connection 310. In this exemplary embodiment, the lower pin assembly 278 comprises a pin connector 288, a connector post 290, a connector spring 292, and a spring retainer 294. The lower pin assembly 278 can threadingly connect to the main body 272 with a thread connection 296. In this exemplary embodiment, the igniter switch module 270 includes a grounding point assembly 314 comprising a washer 316, a fastener 318, and a grounding wire connector 320. The fastener 318 can thread into a port 308 to attach the grounding point assembly 314 onto the main body 272. The igniter switch 274 can be connected to the upper pin assembly 276 with an uphole switch wire 302 and connected to the lower pin assembly 278 with a downhole switch wire 304. A grounding wire 306 from the igniter switch 274 can be connected to the grounding wire connector 320 of the grounding point assembly 314.

The pressure inside the setting tool 42 will ground out the igniter switch 274. Returning to FIG. 9, the setting tool initiator is assembled by installing the igniter assembly 240 into the igniter compartment 222 and threadingly connecting the igniter retainer 204 to the switch housing 202. The igniter switch module 270 can be tested before installing into the switch compartment 220 of the switch housing 202. The housing connector 72 is threadingly connected to the switch housing 202. The switch housing 202 is threadingly coupled to the setting tool 42 with the downhole connector 80 and seal assembly 96 of switch housing 202. Turning to FIG. 10, the retaining spring 244 bias the movable isolator 208 towards the isolator port 226. The igniter 246 is pushed into contact with the igniter retainer 204 by the spring force of the retaining spring 244. The atmospheric pressure on either side of the seal assembly 248 on the movable isolator 208 is approximately equal. The pressure uphole of the seal assembly 248 is the pressure inside the switch compartment 220 that is approximately atmospheric pressure. The pressure downhole of the seal assembly 248 is the pressure inside the setting tool 42 that is approximately atmospheric pressure. Therefore, the movable isolator 208 is pressure balanced.

Figure 12:
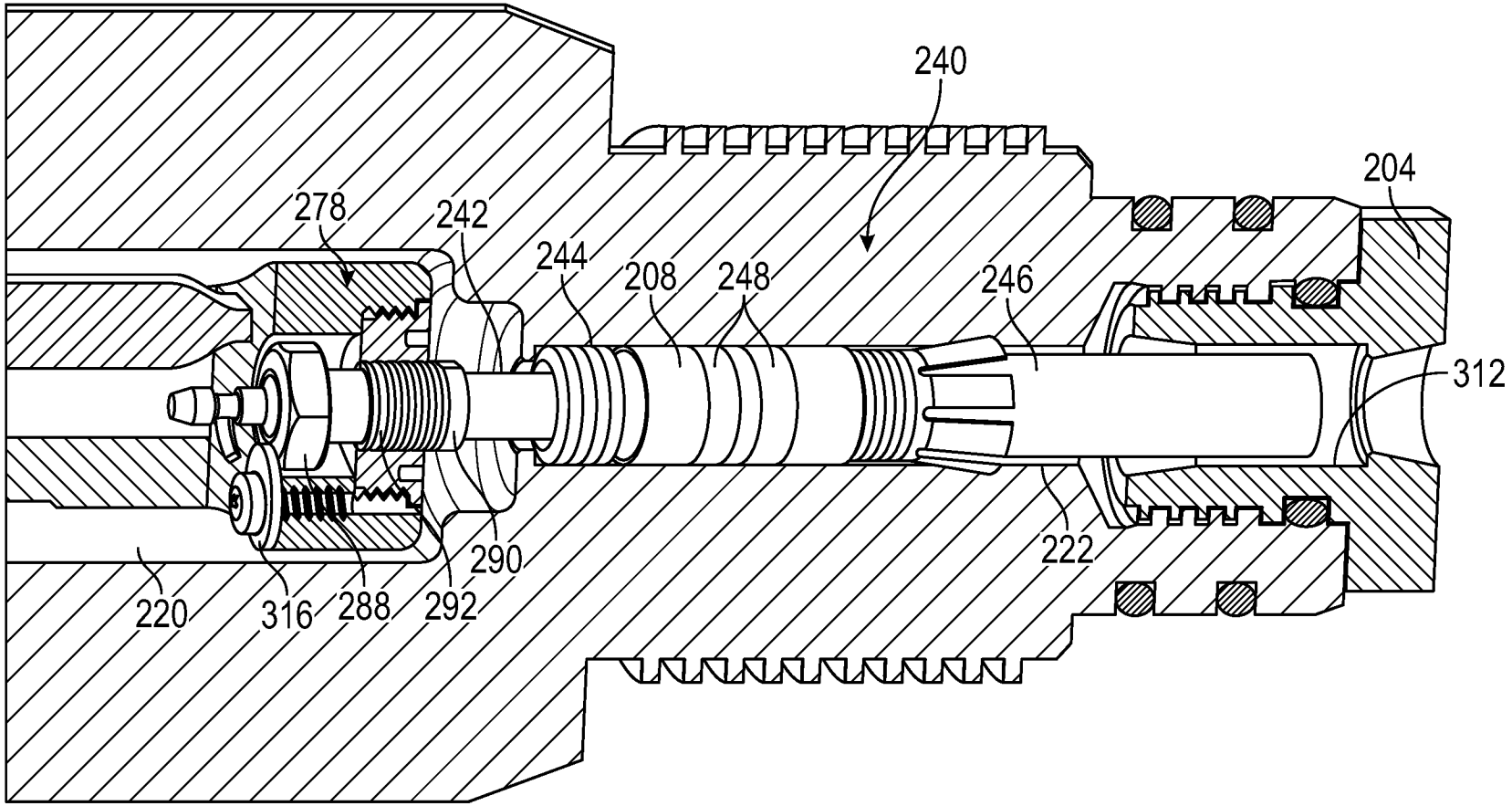
FIG. 12 is a partial cross-sectional view of an igniter assembly installed in a setting tool initiator in a second position according to a further embodiment of the present disclosure.

The ignition of the combustible element 49 inside the setting tool 42 by the igniter 246 will produce high pressure gas. Turning now to FIG. 12, pressure within the setting tool 42 is greater than pressure within the switch compartment 220 which unbalances the movable isolator 208 and bias the movable isolator towards the switch compartment 220. For clarity, the inner bore 312 of the igniter retainer 204 is fluidly connected to the setting tool 42 and therefore the pressure within the setting tool 42 is also the pressure within the inner bore 312. The fluid pressure within the inner bore 312 urges the movable isolator 208 and seal assembly 248 towards the switch compartment 220. The movement of the movable isolator 208 within the igniter compartment 222 towards the switch compartment 220 compresses the retaining spring 244 and extends the insulated pin connector 242 into the switch compartment 220. The movement of the insulated pin connector 242 into the switch compartment 220 pushes the connector post 290 of the lower pin assembly 278 towards the spring retainer 294, compresses the connector spring 292, and moves the pin connector 288 into contact with the washer 316 of the grounding point assembly 314. The contact of the pin connector 288 of the lower pin assembly 278 to the washer 316 of the grounding point assembly 314 grounds the igniter switch 274. The grounding of the igniter switch 274 breaks communication with the surface personnel.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A system for plugging a wellbore extending from the surface and into a subterranean earthen formation, the system comprising:

a plug comprising an annular sealing element and having an initial configuration configured to permit fluid flow around the plug in the wellbore and a set configuration configured to plug the wellbore whereby fluid flow around the plug in the wellbore is restricted;

a setting tool configured to couple with the plug and comprising an energetic element, the setting tool configured to shift the plug from the initial configuration to the set configuration in response to ignition of the energetic element; and a setting tool initiator comprising an igniter switch and an igniter, wherein the setting tool initiator is configured to ignite the energetic element of the setting tool in response to ignition of the igniter;

wherein the igniter switch has an operational state in which the igniter switch is configured to receive electrical signals from the surface and an inoperable state in which the igniter switch is not configured receive electrical signals from the surface, and wherein the setting tool initiator is configured to shift the igniter switch from the operational state to the inoperable state in response to the ignition of the igniter;

wherein the setting tool initiator comprises an initiator housing having a switch compartment in which the igniter switch is positioned, and an igniter compartment in which the igniter is located, and wherein a fluid flowpath extends from the igniter compartment to the switch compartment.

2. The plugging system according to claim 1, wherein the setting tool initiator is configured to physically disable the igniter switch in response to the ignition of the igniter.

3. The plugging system according to claim 1, wherein the setting tool initiator is configured to expose the igniter switch to combustion products generated by the igniter in response to the ignition of the igniter.

4. The plugging system according to claim 1, wherein the setting tool initiator is configured to permanently shift the igniter switch from the operational state to the inoperable state.

5. The plugging system according to claim 1, wherein the fluid flowpath is configured to expose the switch compartment to combustion products from the igniter compartment in response to the ignition of the igniter.

6. The plugging system according to claim 1, further comprising a surface controller in signal communication with the igniter switch when the igniter switch is in the operational state and not in signal communication with the igniter switch when the igniter switch is in the inoperable state.

7. A system for plugging a wellbore extending from the surface and into a subterranean earthen formation, the system comprising:

a plug comprising an annular sealing element and having an initial configuration configured to permit fluid flow around the plug in the wellbore and a set configuration configured to plug the wellbore whereby fluid flow around the plug in the wellbore is restricted;

a setting tool configured to couple with the plug and comprising an energetic element, the setting tool configured to shift the plug from the initial configuration to the set configuration in response to ignition of the energetic element; and a setting tool initiator comprising an igniter switch and an igniter, wherein the setting tool initiator is configured to ignite the energetic element of the setting tool in response to ignition of the igniter;

wherein the igniter switch has an operational state in which the igniter switch is configured to receive electrical signals from the surface and an inoperable state in which the igniter switch is not configured receive electrical signals from the surface, and wherein the setting tool initiator is configured to shift the igniter switch from the operational state to the inoperable state in response to the ignition of the igniter;

wherein the setting tool initiator further comprises:

a switch chassis having an interior in which the igniter switch is positioned; and an igniter adapter coupled to the switch chassis and having an interior in which the igniter is positioned.

8. The plugging system according to claim 7, wherein the switch chassis positions the igniter switch at a predefined distance from the igniter.

9. The plugging system according to claim 7, wherein the setting tool initiator further comprises an igniter spring positioned in the interior of the igniter adapter, wherein the igniter spring electrically connects the igniter switch with the igniter.

10. A setting tool initiator for actuating a setting tool of a plugging system, the setting tool initiator comprising:

an igniter switch having an operational state in which the igniter switch is configured to receive and transmit electrical signals and an inoperable state in which the igniter switch is not configured to transmit or receive electrical signals; and an igniter ignitable by the igniter switch and configured to actuate the setting tool in response to ignition of the igniter when the setting tool initiator is connected to the setting tool, wherein the setting tool initiator is configured to shift the igniter switch from the operational state to the inoperable state in response to the ignition of the igniter;

an initiator housing in which the igniter switch and the igniter are received;

a switch chassis positioned in the initiator housing and having an interior in which the igniter switch is positioned; and an igniter adapter positioned in the initiator housing and coupled to the switch chassis, wherein the igniter adapter has an interior in which the igniter is positioned.

11. The setting tool initiator according to claim 10, wherein the switch chassis positions the igniter switch at a predefined distance from the igniter.

12. The setting tool initiator according to claim 11, wherein the predefined distance is 1.75 inches or less.

13. The setting tool initiator according to claim 10, wherein the setting tool initiator further comprises an igniter spring positioned in the interior of the igniter adapter, wherein the igniter spring electrically connects the igniter switch with the igniter.

14. A setting tool initiator for actuating a setting tool of a plugging system, the setting tool initiator comprising:

an igniter switch having an operational state in which the igniter switch is configured to receive and transmit electrical signals and an inoperable state in which the igniter switch is not configured to transmit or receive electrical signals; and an igniter ignitable by the igniter switch and configured to actuate the setting tool in response to ignition of the igniter when the setting tool initiator is connected to the setting tool, wherein the setting tool initiator is configured to shift the igniter switch from the operational state to the inoperable state in response to the ignition of the igniter;

an initiator housing in which the igniter switch and the igniter are received, and wherein the initiator housing defines an igniter compartment in which the igniter is positioned and a switch compartment in which the igniter is positioned;

wherein a fluid flowpath is formed extending through the initiator housing from the igniter compartment to the switch compartment.

15. The setting tool initiator according to claim 14, wherein the initiator housing has a maximum length of 6.5 inches or less.

16. The setting tool initiator according to claim 14, wherein the switch compartment has a maximum inner diameter of 1.50 inches or less.

* * * * *